US010704261B2

(12) United States Patent
Gilbert et al.

(10) Patent No.: US 10,704,261 B2
(45) Date of Patent: Jul. 7, 2020

(54) REINFORCED COMPOSITE COLUMN

(71) Applicant: Jack Walters & Sons, Corp., Allenton, WI (US)

(72) Inventors: Fredrick R. Gilbert, Fairfield, IL (US); Daniel Pederson, Fond du Lac, WI (US); Andrew Pritzl, Lodi, WI (US); Caynen Klessig, Theresa, WI (US)

(73) Assignee: Jack Walters & Sons, Corp., Allenton, WI (US)

( * ) Notice: Subject to any disclaimer, the term of this patent is extended or adjusted under 35 U.S.C. 154(b) by 0 days.

(21) Appl. No.: 16/584,459

(22) Filed: Sep. 26, 2019

(65) Prior Publication Data

US 2020/0048907 A1 Feb. 13, 2020

Related U.S. Application Data

(63) Continuation of application No. 16/148,610, filed on Oct. 1, 2018, now Pat. No. 10,443,240.

(60) Provisional application No. 62/566,847, filed on Oct. 2, 2017.

(51) Int. Cl.

| | |
|---|---|
| ***E04C 3/36*** | (2006.01) |
| ***E04B 1/41*** | (2006.01) |
| ***E04C 5/01*** | (2006.01) |
| ***E04B 1/26*** | (2006.01) |
| ***E04C 3/32*** | (2006.01) |
| ***E04B 1/38*** | (2006.01) |

(52) U.S. Cl.

CPC ..... *E04C 3/36* (2013.01); *E04B 1/2604* (2013.01); *E04B 1/40* (2013.01); *E04C 3/32* (2013.01); *E04C 5/01* (2013.01); *E04B 2001/2648* (2013.01); *E04B 2001/2684* (2013.01); *E04B 2001/405* (2013.01)

(58) Field of Classification Search

CPC ... E04C 3/36; E04C 3/005; E04C 5/01; E04B 1/2604; E04B 1/41; E04B 2001/2648; E04B 2001/2684; E04B 2001/405

See application file for complete search history.

(56) References Cited

U.S. PATENT DOCUMENTS

| | | | |
|---|---|---|---|
| 797,083 | A | 8/1905 | Stowe |
| 1,402,304 | A | 1/1922 | Lord |
| 1,688,063 | A | 10/1928 | Trainor |

(Continued)

FOREIGN PATENT DOCUMENTS

| | | |
|---|---|---|
| CN | 203878751 | 10/2014 |
| CN | 204023884 | 12/2014 |
| WO | WO 2014187726 | 11/2014 |

OTHER PUBLICATIONS

Perma-Column Brochure, Perma-Column, Inc., 2007.

(Continued)

*Primary Examiner* — Christine T Cajilig

(74) *Attorney, Agent, or Firm* — Andrus Intellectual Property Law, LLP

(57) ABSTRACT

A building support column includes a lower assembly with a connection bracket that includes a bottom plate. A body that includes plastic defines an exterior perimeter about support rods that extend from the bottom plate of the connection bracket. An adjustment leg that includes a threaded portion is movable within a center hole of the body to define a distance between the foot and the bottom plate.

20 Claims, 12 Drawing Sheets

(56) References Cited

U.S. PATENT DOCUMENTS

| | | | | |
|---|---|---|---|---|
| 2,191,979 | A | 2/1940 | Bierbach | |
| 2,400,266 | A | 5/1946 | Ernest | |
| 2,877,520 | A | 3/1959 | Jureit | |
| 3,090,088 | A | 5/1963 | Foley et al. | |
| 3,172,171 | A | 3/1965 | Knight | |
| 3,211,043 | A | 10/1965 | Carol | |
| 3,390,902 | A | 7/1968 | Jureit | |
| 3,427,055 | A | 2/1969 | Jureit et al. | |
| 3,454,292 | A | 7/1969 | Sanford | |
| 3,487,170 | A | 12/1969 | Pearce et al. | |
| 3,703,304 | A | 11/1972 | Losse | |
| 3,813,842 | A | 6/1974 | Troutner | |
| 3,841,195 | A | 10/1974 | Jureit | |
| 3,846,030 | A | 11/1974 | Katt | |
| 3,911,548 | A | 10/1975 | Perry | |
| 4,157,575 | A | 6/1979 | Jureit | |
| 4,299,511 | A | 11/1981 | Demers | |
| 4,318,652 | A | 3/1982 | Gore | |
| 4,336,678 | A | 6/1982 | Peters | |
| 4,440,099 | A | 4/1984 | Brachet | |
| 4,479,341 | A | 10/1984 | Eberle | |
| 4,486,155 | A | 12/1984 | Roca-Niegra | |
| 4,488,389 | A | 12/1984 | Farmont | |
| 4,501,102 | A | 2/1985 | Knowles | |
| 4,571,114 | A | 2/1986 | Rionda et al. | |
| 4,586,550 | A | 5/1986 | Kitipornchai | |
| 4,598,510 | A * | 7/1986 | Wagner, III | E04F 15/02183 52/126.6 |
| 4,639,176 | A | 1/1987 | Smith | |
| 4,653,242 | A | 3/1987 | Ezard | |
| 4,679,367 | A | 7/1987 | Geisthardt | |
| 4,710,083 | A | 12/1987 | Wolf | |
| 4,734,003 | A | 3/1988 | Smith | |
| 4,737,060 | A | 4/1988 | Brickhead | |
| 4,738,071 | A | 4/1988 | Ezard | |
| 4,833,859 | A | 5/1989 | Wolf | |
| 4,887,952 | A | 12/1989 | Wolf | |
| 5,006,006 | A | 4/1991 | Lehtonen | |
| 5,048,256 | A | 9/1991 | Thorsnes | |
| 5,056,750 | A | 10/1991 | Ellithrope | |
| 5,234,279 | A | 8/1993 | Poutanen | |
| 5,354,411 | A | 10/1994 | Lines | |
| 5,375,384 | A | 12/1994 | Wolfson | |
| 5,573,354 | A | 11/1996 | Koch | |
| 5,618,371 | A | 4/1997 | Sing | |
| 5,651,739 | A | 7/1997 | Carlsen | |
| 5,678,382 | A | 10/1997 | Liskey | |
| 5,735,087 | A | 4/1998 | Olden | |
| 5,833,421 | A | 11/1998 | Les et al. | |
| 5,848,866 | A | 12/1998 | Black, Jr. | |
| 5,852,909 | A | 12/1998 | Solitis et al. | |
| 5,896,716 | A | 4/1999 | Jalla | |
| 5,966,892 | A | 10/1999 | Platt | |
| 6,019,549 | A | 2/2000 | Blair et al. | |
| 6,203,232 | B1 | 3/2001 | Ward | |
| 6,299,378 | B1 | 10/2001 | Griffith | |
| 6,347,489 | B1 | 2/2002 | Marshall | |
| 6,409,156 | B2 | 6/2002 | Dent | |
| 6,561,736 | B1 | 5/2003 | Doleshal | |
| 6,964,139 | B2 | 11/2005 | Meyer et al. | |
| 7,275,351 | B2 | 10/2007 | Knepp | |
| 7,343,713 | B2 | 3/2008 | Knepp et al. | |
| 7,574,841 | B2 | 8/2009 | Knepp et al. | |
| 7,748,190 | B1 | 7/2010 | Loper | |
| 7,909,315 | B2 | 3/2011 | Hill | |
| 7,980,034 | B2 | 7/2011 | Fehr et al. | |
| 8,056,299 | B2 | 11/2011 | Liskey | |
| 8,070,390 | B2 | 12/2011 | Castle | |
| 8,347,571 | B2 | 1/2013 | Fehr et al. | |
| 8,347,584 | B2 | 1/2013 | Fehr et al. | |
| 8,397,442 | B2 | 3/2013 | Laurin | |
| 8,407,967 | B2 | 4/2013 | Brindle | |
| 8,453,416 | B2 | 6/2013 | Brindle | |
| 8,584,413 | B1 | 11/2013 | Keller, Sr. | |
| 8,826,629 | B1 | 9/2014 | Brindle | |
| 8,959,857 | B1 | 2/2015 | Lin | |
| 9,038,353 | B2 | 5/2015 | Huncovsky | |
| 9,070,390 | B2 | 6/2015 | Green et al. | |
| 9,217,248 | B2 | 12/2015 | Knepp et al. | |
| 9,234,350 | B1 | 1/2016 | Gilbert et al. | |
| 9,428,902 | B1 | 8/2016 | Lofranco et al. | |
| 9,450,814 | B2 | 9/2016 | Negron et al. | |
| 9,528,265 | B1 | 12/2016 | Gilbert et al. | |
| 9,540,814 | B2 | 1/2017 | Meyer et al. | |
| 9,719,257 | B2 | 8/2017 | Gilbert et al. | |
| 2005/0016111 | A1 | 7/2005 | Knepp et al. | |
| 2006/0037256 | A1 | 2/2006 | Pryor | |
| 2006/0133912 | A1 * | 6/2006 | Commins | E04B 1/2604 411/536 |
| 2008/0283702 | A1 * | 11/2008 | Ikerd | E04B 1/2604 248/228.1 |
| 2011/0131893 | A1 | 6/2011 | Chen | |
| 2011/0250443 | A1 | 10/2011 | Schall | |
| 2013/0239512 | A1 | 9/2013 | Yang | |
| 2013/0326968 | A1 | 12/2013 | Meyer et al. | |
| 2014/0373471 | A1 | 12/2014 | Knepp | |
| 2016/0168840 | A1 | 6/2016 | Monty et al. | |
| 2017/0037892 | A1 | 2/2017 | Higgins | |

OTHER PUBLICATIONS

Flouro et al., "Moment Resisting Wood Post-to-Concrete Pier Connection", Biological Systems Engineering Department University of Wisconsin-Madison, 2006.

Columns Brochure, Walters Buildings, Nov. 2008.

* cited by examiner

REINFORCED COMPOSITE COLUMN

CROSS-REFERENCE TO RELATED APPLICATION

This application claims priority to U.S. patent application Ser. No. 16/148,610 filed on Oct. 1, 2018, which claims priority to U.S. Provisional Patent Application No. 62,566,847 filed on Oct. 2, 2017.

BACKGROUND

In the construction of buildings, outdoor structures, or the like, it is often desirable to utilize a beam or column which includes a plurality of boards rather than an integral post made from a single piece of building material such as wood. Many embodiments of composite assemblies use one or more connectors to connect the plurality of component boards into the composite assembly. The composite assembly made from a plurality of board can serve as a less expensive substitute for integral posts made from a single piece of wood. Additionally, due to the laminated structure of the composite assembly, such columns can often be stronger than a similarly dimensioned column constructed from a single piece of material.

It is also known to provide a composite assembly that includes a series of elongated layers which are secured together in a lengthwise fashion but are also secured to an elongated ground-engaging member. In such composite assembly, particularly a column, the upper elongated members are normally constructed of a non-treated wood, while the lower elongated member is typically constructed of a decay inhibitive or resistive material. Previously this had been provided by chemically treated wood, for example wood infused with a chemical compound for example, chromated copper arsenate (CCA) to prevent the natural process of decay of the ground-engaging wood. Restrictions on the use of this and other potentially hazardous chemicals have prompted the development and use of other solutions for providing the ground-engaging portion of composite construction columns. Recently, the applicant has developed a composite assembly for a support column that uses a ground-engaging portion that is constructed of a plastic or plastic containing material. The support columns are described in further detail, for example in U.S. Pat. No. 9,719,257, previously published as Application Publication No. 2017/0073972 and entitled Friction Fit Composite Column, which is incorporated herein by reference in its entirety.

BRIEF DISCLOSURE

An exemplary embodiment of a building support column includes a lower assembly and an upper assembly. The lower assembly includes a connection bracket with a bottom plate and first and second connection blades extending away from the bottom plate in a first direction. A hole through the bottom plate is in a position between the first and second connection blades. A plurality of support rods are secured to the connection bracket and extend away from the bottom plate in a direction opposite the connection blades. A body includes plastic and defines an exterior perimeter about the plurality of support rods. A center hole is oriented along a central axis of the body and is aligned with the hole of the bottom plate. The upper assembly includes a plurality of elongated layers of wood. The plurality of elongated layers of wood are secured to each other along elongated faces of the layers of wood. The connection bracket secures the upper assembly to the lower assembly with a connection blade extending between the elongated faces of adjacent elongated layers of the upper assembly. A reinforcement plate includes a plate and a plurality of teeth extend away from a first side of the plate. The teeth of the reinforcement plate engage into a single elongated layer of the plurality of elongated layers.

In additional exemplary embodiments, the connection bracket also includes first and second lips that extend from opposite edges of the bottom plate and are oriented perpendicular to the first and second connection blades. Drainage holes are formed into respective corners between the bottom plate and the first and second lips and are located between the first and second connection blades. The lower ends of the plurality of elongated layers of wood may be notched to accommodate the first and second lips so as to provide a consistent exterior perimeter between the upper assembly and the lower assembly.

In further exemplary embodiments, the reinforcement plate is a first reinforcement plate and is secured into a first elongated face of a center elongated layer of the plurality of elongated layers of wood. A second reinforcement plate includes teeth that engage into a second elongated face of the center elongated layer. Notches may be positioned along interior elongated faces of exterior elongated layers of the plurality of elongated layers. The notches are dimensioned to accommodate the connection blades. The first reinforcement plate is positioned between the first connection blade and the center elongated layer. The first reinforcement plate extends along the first connection blade and beyond an upper end of the first connection blade. The second reinforcement plate is positioned between the second connection blade and the center elongated layer and the second reinforcement plate extends along the second connection blade and beyond an upper end of the second connection blade. Exemplary third and fourth reinforcement plates are secured to respective exterior faces of the exterior elongated layers.

DETAILED DISCLOSURE

Figure 1:
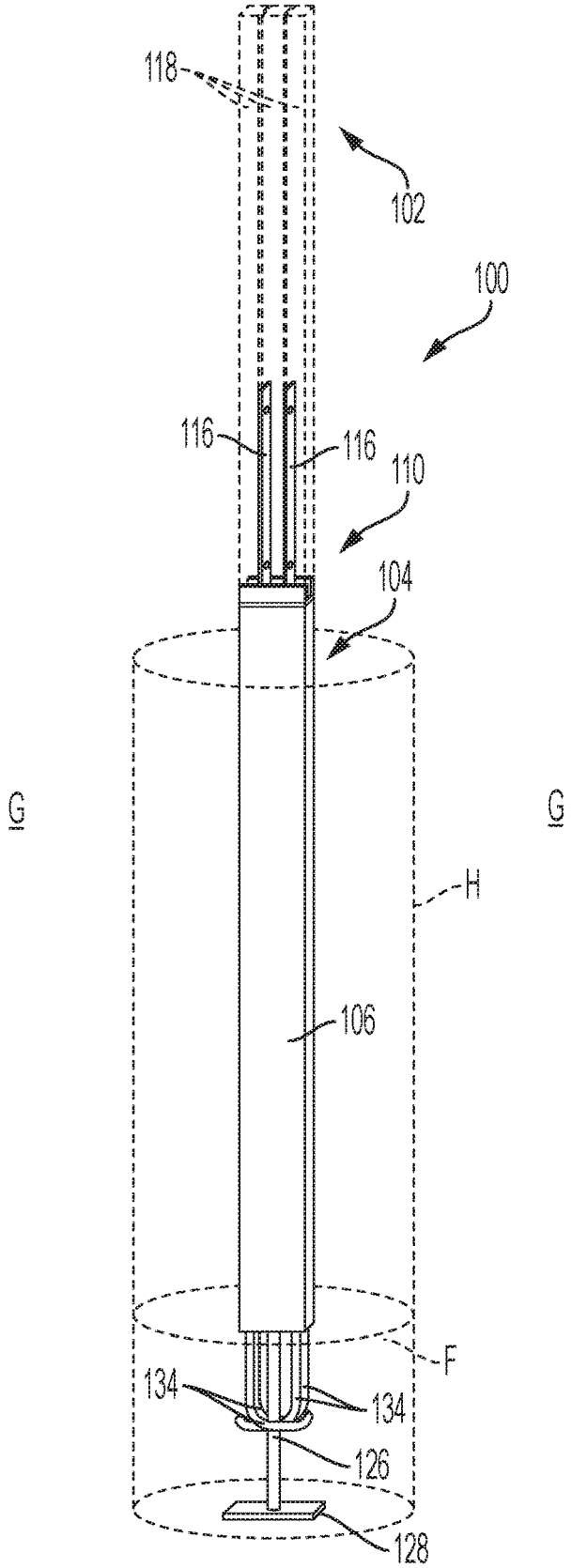
FIG. 1 depicts an exemplary embodiment of a composite assembly.

FIG. 1 depicts an exemplary embodiment of a composite assembly 100 in the form of a vertical structural column. The composite assembly 100 is positioned within a hole H dug into the ground G at location for the construction of a building. The composite assembly 100 includes an upper assembly 102 which is exemplarily constructed of a plurality of laminated elongated layers 118 in the form of wooden boards to form a wooden column. The elongated layers of the upper assembly 102 may be secured to one another in a variety of known manners, including the use of one sided and two sided connection plates secured between and/or across the wooden boards of the upper assembly 102.

The composite assembly 100 further includes a lower assembly 104. The lower assembly 104 is designed for ground contact and is exemplarily constructed of a combination of metal and plastic materials as described in further detail herein. In exemplary embodiments, the lower assembly 104 is constructed of materials that are suitable for ground contact without risk or susceptibility to rot or decay and which do not include CCA or similar chemicals.

The lower assembly 104 includes a body 106 that is exemplarily constructed of a plastic material. Examples of such a plastic material include, but are not limited to high molecular weight polypropylene (HMWPE), polypropylene (PP), low density polyethylene (LDPE). In further exemplary embodiments, the body 106 is constructed of a combination of materials, including, but not limited to an exemplary construction with at least 66% polypropylene (PP) and at least 9% low density polyethylene (LDPE). In still further exemplary embodiments, about 15% fiberglass shorts and/or about 1% color may be added to the mixture. In still further exemplary embodiments some or all of the body 106 may be constructed of recycled plastic. In other embodiments, the body 106 may further include other filler or binder materials in addition to the plastic. These may include plant and/or wood fibers.

Figure 2:
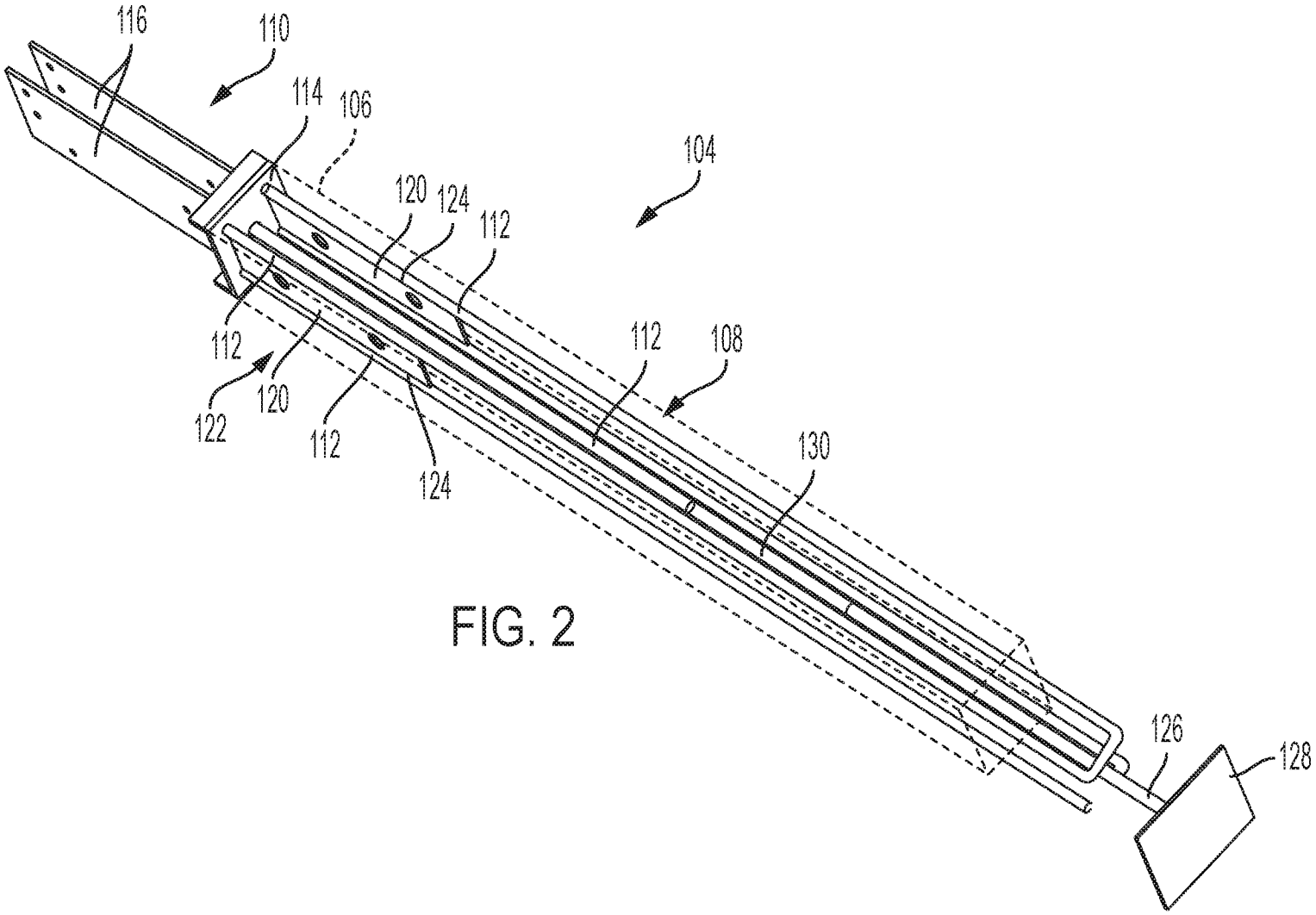
FIG. 2 depicts an exemplary embodiment of a lower assembly.

FIG. 2 is perspective view of an exemplary embodiment of the lower assembly 104 which depicts the body 106 in phantom. This depiction reveals the internal metal skeleton 108, a portion of which the body 106 is formed about. The skeleton 108 includes a connection bracket 110 and a plurality of support rods 112 which extend from the connection bracket through the interior of the body 106 and exit through the bottom of the body 106.

The connection bracket 110 is exemplarily includes a bottom plate 114. One or more, and exemplarily two, connection blades 116 extend from the bottom plate 114. It will be recognized that the exemplary embodiment depicted is configured to connect to an upper assembly comprised of three plys, or elongated layers, of wood. These may exemplarily be 2×6 wooden boards. The two connection blades 116 are exemplarily configured to extend between adjacent layers as depicted. Other embodiments may include other numbers of elongated layers in the upper assembly and have a corresponding increase in the number of connection blades. The wooden boards of the upper assembly 102 (FIG. 1) are secured to the connection blades 116. The connection bracket 110 further includes at least one, and exemplarily two, support plates 120. The support rods 112 are exemplarily secured to the support plates 120. In embodiments, the support rods 112 are positioned exterior of the support plates 120. In one embodiment, this means that the support rods 112 are secured to respective outer faces 122 of the support plates 120. In another embodiment, the support rods 112 may be secured to the edges 124 of the support plates 120. In still further exemplary embodiments, the support rods 112 are secured to the support plates 120, for example by welding, while in other embodiments, the support rods 112 are positioned within the body 106 without being directly secured to the support plates 120.

In embodiments as depicted in FIGS. 1 and 2, the lower assembly 104 further includes an adjustment leg 126 which terminates in a foot 128 secured at an exterior end of the adjustment leg 126. In exemplary embodiments, the adjustment leg 126 is held by a friction fit within a center hole 130 through the body 106. In an exemplary embodiment, the center hole 130 is dimensioned to be slightly smaller than an exterior diameter of the adjustment leg 126 at an interior end of the adjustment leg 126 so that the adjustment leg 126 resiliently engages with the material of the body 106 to resiliently hold the adjustment leg 126 and the foot 128 secured thereto in a predetermined relationship relative to the connection bracket 110, and particularly the bottom plate 114 of the connection bracket 110.

The center hole 130 exemplarily extends along the entire length of the body 106. In an embodiment, the center hole 130 is cast or molded into the lower assembly 104 while in another embodiment, the center hole 130 may be machined into the body 106 of the lower assembly 104 as a separate manufacturing step. The center hole 130 is exemplarily aligned with a hole 132 located in the bottom plate 114.

In an exemplary embodiment, the exterior of the adjustment leg 126 may further include ribbing and/or surface texture which facilitates the friction fit between the adjustment leg 126 and the material of the body 106 as the adjustment leg 126 is located in the center hole 130. Additionally, a plastic, malleable, deformable, or otherwise resilient property of the material of the body 106 further increases the friction between the body 106 and the adjustment leg 126 to hold the adjustment leg 126 and the foot 128 in a position relative to the connection bracket 110.

In an exemplary embodiment, the friction fit between the body 106 and adjustment leg 126 is exemplarily strong enough to support the weight of the entire lower assembly 104 such that the adjustment leg 126 can be moved to a desired position between the bottom plate 114 and the foot 128. In an exemplary and non-limiting embodiment, the body 106 may be 48 inches long and the adjustment leg, may exemplarily be 24 inches long. Therefore, an exemplary and non-limiting embodiment, may be adjustable for example between 54 inches and 66 inches while other embodiments may be dimensioned to be adjusted along other ranges.

When the lower assembly 104 is positioned within the hole H, the foot 128 engages the ground at the bottom of the hole and the bottom plate 114 of the connection bracket 110 is located at the predetermined position above the foot 128 established by the friction fit between the adjustment leg 126 and the body 106. The friction fit between the adjustment leg 126 and the body 106 is further strong enough to support the lower assembly 104, and in particular to support the combined weight of the connection bracket 110, the skeleton 108, and the body 106 from moving downward into the hole H while the footing F is poured, set, and cured or partially cured about at least a portion of the lower assembly 104, and in particular the foot 128. The support rods 112 extend exterior of the bottom of the body 106 at an end opposite the connection bracket 110. The support rods 112 end in end projections 134 which are oriented in a direction non-axial to the rest of the support rod 112. In embodiments the end projections 134 are oriented in a direction towards perpendicular from the rest of the support rod 112. In an exemplary embodiment, the footing F extends upwards to cover at least a portion of the end projections 134. In another exemplary embodiment, the footing F extends upwards to cover at least a portion of the body 106.

While the friction fit between the adjustment leg 126 and the body 106 resiliently hold the adjustment leg 126 in a predetermined position, installation personnel may use the hole 132 through the bottom plate 114 to access the adjustment leg 126, for example with a rod (not depicted) to apply a force to the end of the adjustment leg 126 that is internal to the body 106 to increase the distance between the foot 128 and the connection bracket 110. The installation personnel may decrease the distance between the foot 128 and the connection bracket 110 by applying a force against the foot 128 to move the foot 128 closer to the connection bracket 110.

Figure 3A:
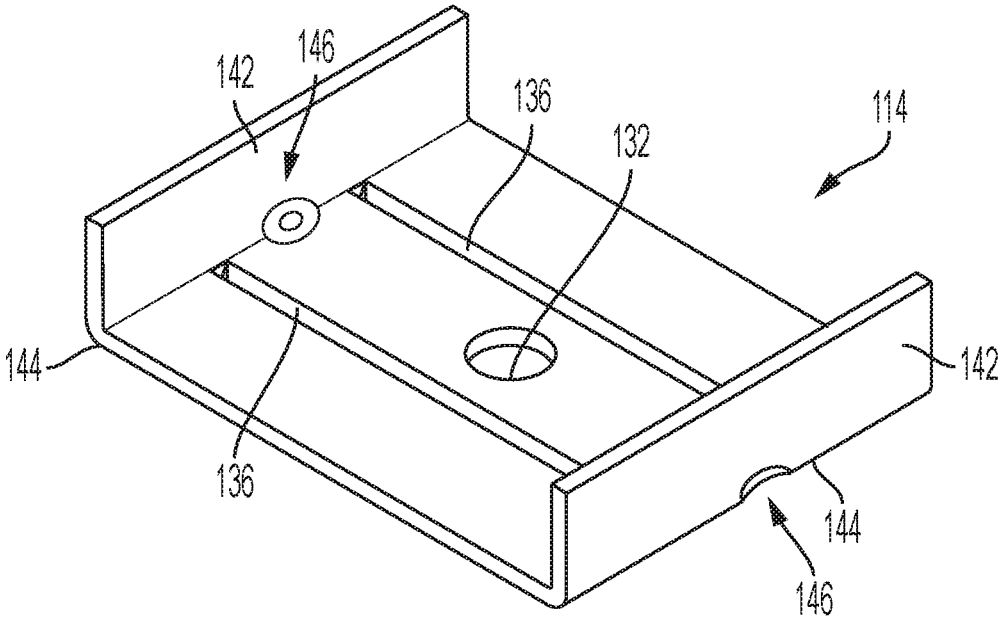
FIG. 3A is a perspective view of an exemplary embodiment of a bottom plate.
Figure 3B:
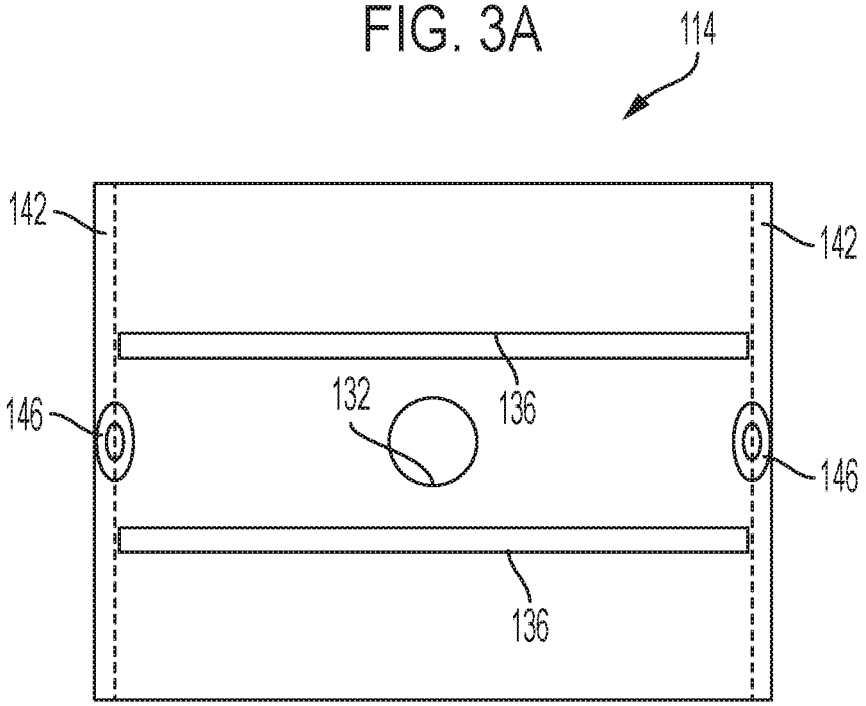
FIG. 3B is a top view of the bottom plate.

FIGS. 3A and 3B depict a perspective view and a top view, respectively of an exemplary embodiment of the bottom plate 114 of a connection bracket 110. The bottom plate 114 includes the hole 132 there through as previously described. In an exemplary embodiment, the bottom plate 114 includes slots 136 which are configured to exemplarily receive a combined connection blade (not depicted) which is a unitary construction comprising both the connection blade 116 and support plate 120 as described above. Exemplarily, such a connection plate extends through the respective slots 136 and is secured to the bottom plate 114, for example by welding. Additionally, the bottom plate 114 may include lip 142 which extend upwards from the bottom plate 114. The lips 142 exemplarily are positioned perpendicular to the slots 136 and, as described herein, function to assist in alignment of the upper assembly 102 (FIG. 1) onto the lower assembly 104. In an exemplary embodiment, the lips 142 are formed by bends 144 in the material of the bottom plate 114 to provide the lips 142 as a unitary piece of the bottom plate 114. The bottom plate 114 further includes drainage holes 146 through the lips 142, exemplarily at the bends 144, or at a corner between the lip 142 and the bottom plate 114, and exemplarily located in a position between the slots 136 and/or connection blades 116. In an exemplary embodiment, the bottom plate 114, and the connection bracket 110 as depicted in FIGS. 1 and 2 are configured to secure to an upper assembly 102 (FIG. 1) that includes a ply of three boards 118. In such an embodiment, moisture may be trapped at the bottom of the center board in the area about the connection bracket 110. The inclusion of a drainage hole 146 in this area has been found to help to preserve the integrity of the upper assembly while having no noticeable impact on the performance of the connection bracket containing the same.

Figure 4A:
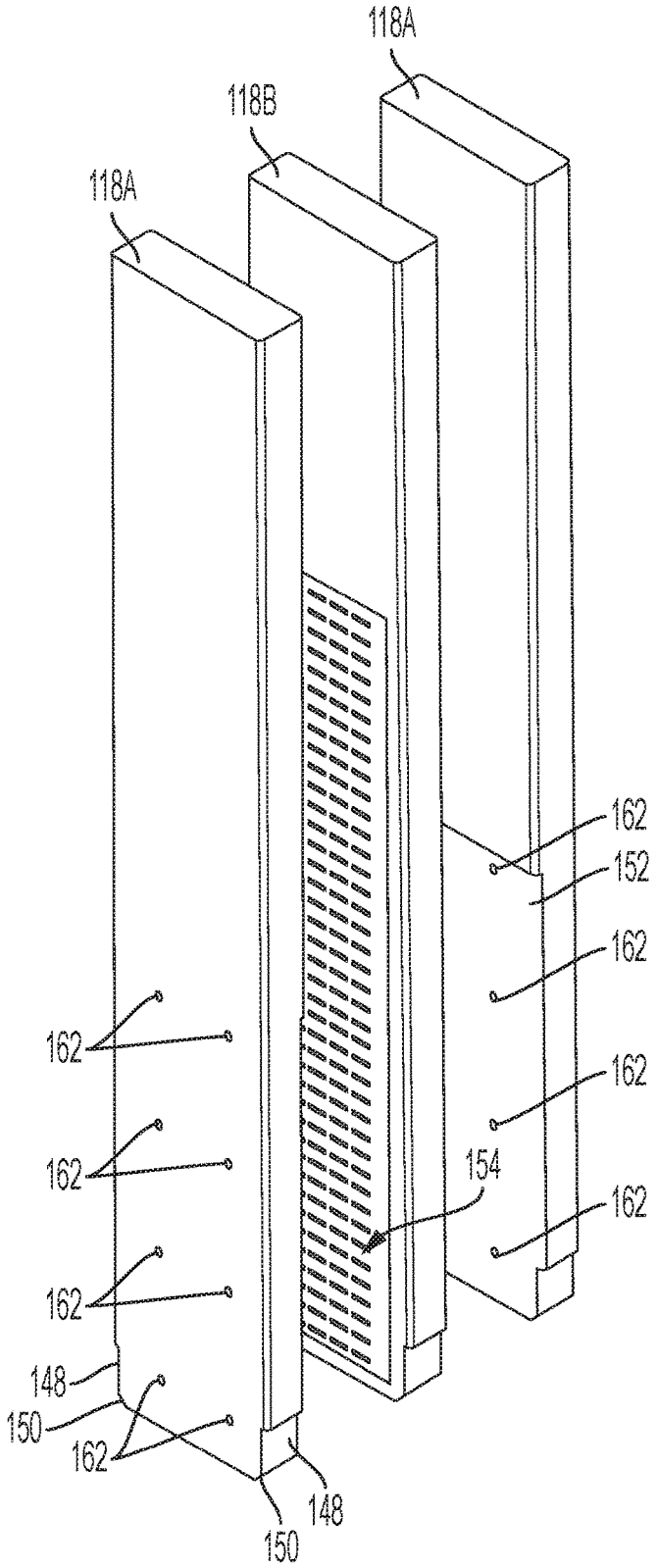
FIG. 4A is a partial exploded perspective view of an exemplary embodiment of an upper assembly.
Figure 4B:
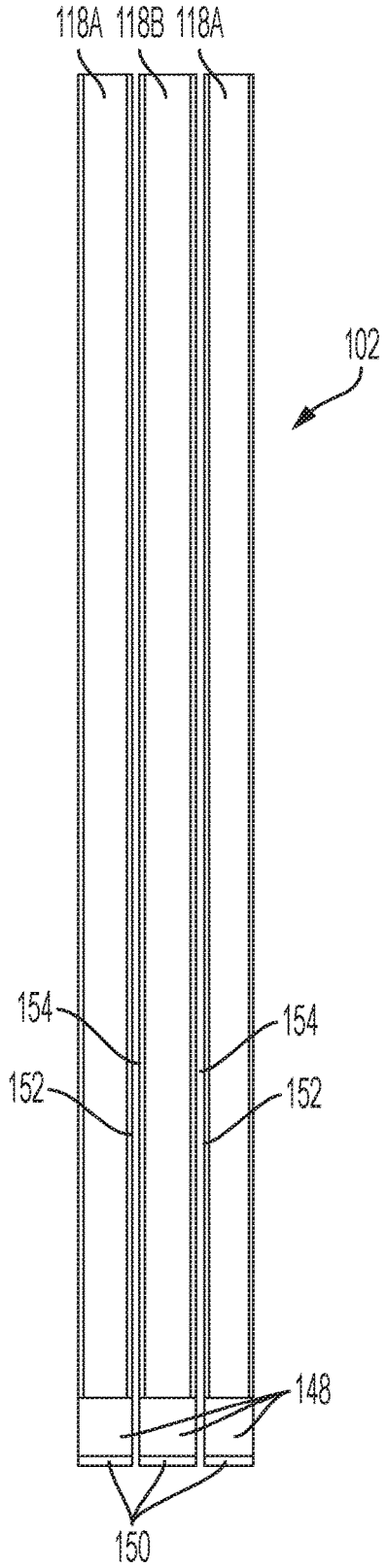
FIG. 4B is a side view of a portion of the upper assembly.
Figure 5A:
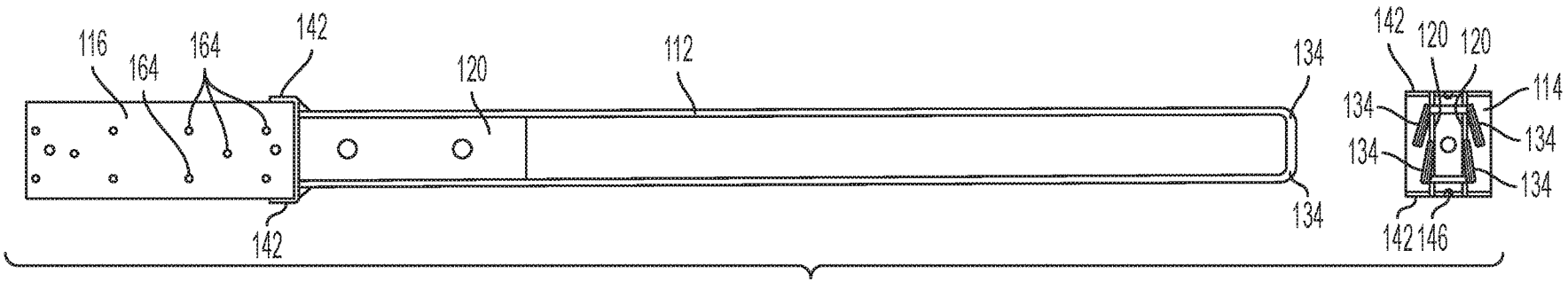
FIG. 5A is an exemplary embodiment of portions of a lower assembly.
Figure 5B:
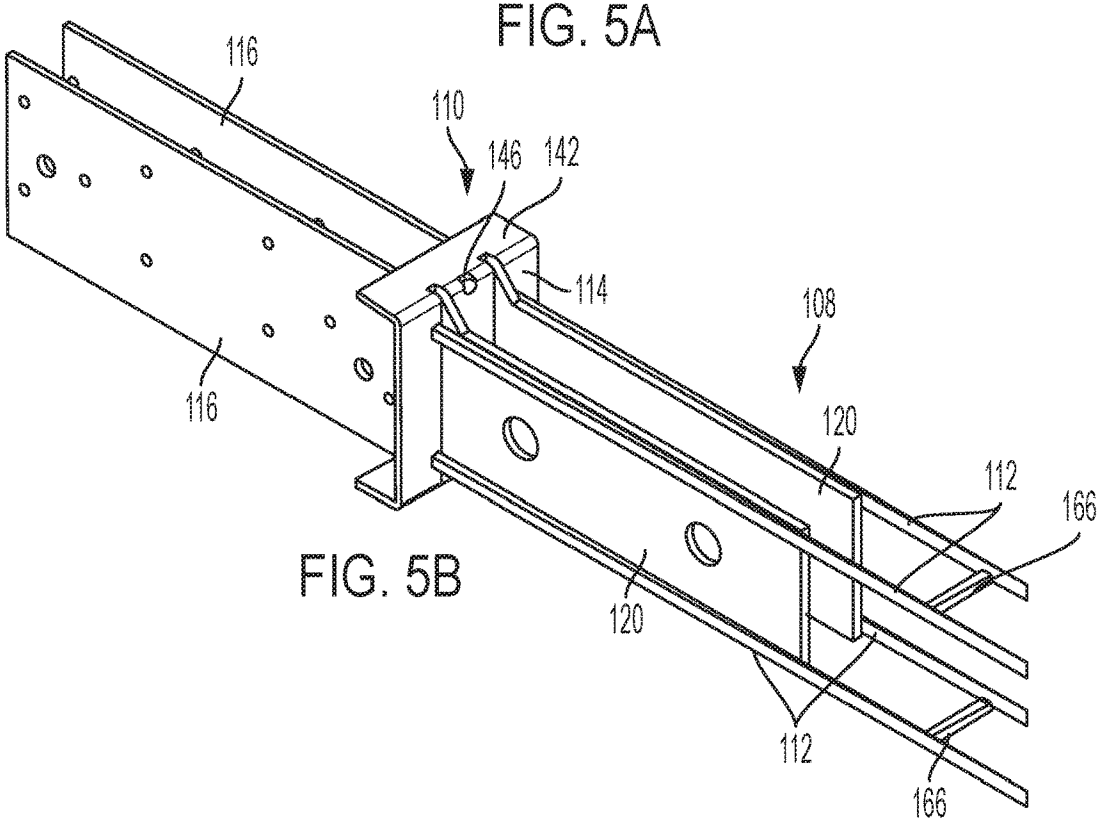
FIG. 5B is a perspective view of the portions of the lower assembly.
Figure 6:
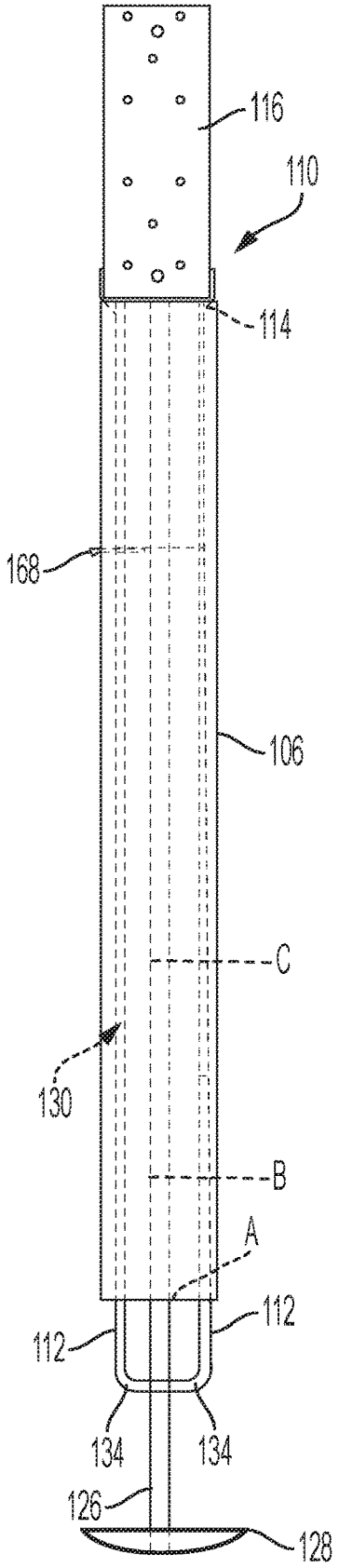
FIG. 6 depicts an exemplary embodiment of a lower assembly.

FIGS. 4-6 all present still further exemplary features as may be provided in composite assemblies 100 as disclosed in the present application. It will be recognized by a person of ordinary skill in the art that one or more of these features may be combined into the embodiments of composite assemblies as depicted and described above as well as any embodiments which may disclosed in U.S. Pat. No. 9,719,257 as incorporated by reference above or understood by a person of ordinary skill in the art in view of such disclosures. FIGS. 4A&B depict a lower end of an upper assembly 102. The upper assembly 102 is exemplarily constructed of a ply of three boards 118. The three boards comprise a center elongated layer and two exterior elongated layers. The boards 118 include end notches 148 formed therein. By way of reference to FIGS. 1 and 3A, the notches 148 of the boards 118 accommodate the lip 142 of the connection bracket 110. As previously noted, the lips 142 of the connection bracket 110 help to accommodate the ends of the boards 118 of the upper assembly 102 to center the upper assembly in alignment with connection bracket 100 and lower assembly 104. In a still further exemplary embodiment, the boards 118 may further include end chamfers 150 which exemplarily accommodate the bend 144 which may form the lip 142 while in another embodiment such chamfers 150 may accommodate a weld between components of the bottom plate 114.

The boards 118, and particularly exterior elongated layers formed by the outer boards 118A include face notches 152 placed into respective interior faces of the board 118A. In an exemplary embodiment, the face notches 152 accommodate the connection blades constructing the connection bracket 110. These series of notches help to accommodate the connection bracket 110 and facilitate a secure connection of the upper assembly 102 to the lower assembly 104 at the connection bracket 110 in a manner that facilitates a secure construction of the upper assembly without forcing the plies of the upper assembly apart which can reduce the strength or effectiveness of the upper assembly.

FIGS. 4A and B further depict reinforcement plate 154 secured to the center elongated layer formed by the center board 118B. It will be recognized that a similar reinforcement plate 154 is located on the center board 118B on the opposite side of the center board 118B, although not depicted in FIGS. 4A and B. The reinforcement plate 154 is a one sided connection plate and may be stamped from a piece of sheet metal or constructed in a variety of known manners. One embodiment of a connection plate is described in further detail in U.S. Pat. No. 9,719,257 as incorporated by reference above, although other exemplary embodiments of reinforcement plates will be recognized.

Figure 7:
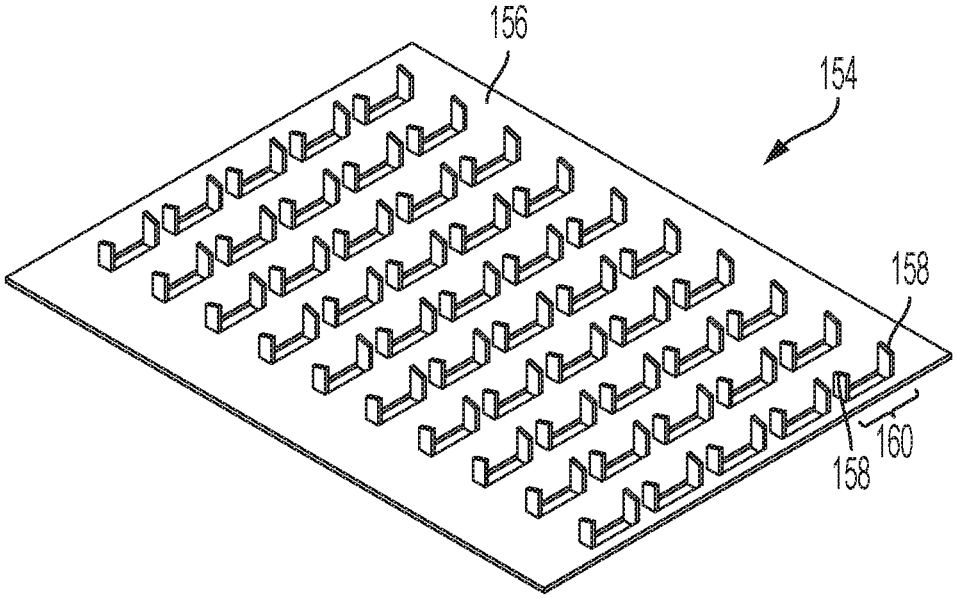
FIG. 7 depicts an exemplary embodiment of a connection plate.

An embodiment of a reinforcement plate is depicted at FIG. 7. The reinforcement plate 154 is exemplarily constructed of a plate 156 which may be sheet metal, including, but not limited to steel, galvanized steel, stainless steel, or aluminum. In an exemplary embodiment, a plurality of teeth 158 are formed in the plate 156 by punching a plurality of tooth pairs 160 out from the metal plate 156. Typically, a reinforcement plate 154 is used to secure two or more boards of wood together to form a composite structure such as a composite column or truss. However, the reinforcement plate 154, as arranged and used in FIGS. 4A&B provide a different function to the composite assembly 100. The reinforcement plate 154 is arranged along the length of the center board 118B and secured solely to the center board from a position just above the end of the center board 118B to a position above the terminus of the face notches 152, which also correspond to the length of the connection blades of the connection bracket 110.

Contrary to other uses, the arrangement described herein is secured only to one board and the tooth pairs do not extend into two or more boards. Despite the tooth pairs only extending into one board, this has been found to improve overall structural integrity of the upper assembly by distributing the moment force about the connection bracket 110 and particularly about the ends of the connection blades 116 of the connection bracket 110 against the center board 118B. Additionally, the reinforcement plates 154 are arranged in this manner on the center board 118B help to maintain the integrity of the wood of the center board 118B against the torque and the rotative forces about the connection bracket 110. Incorporation of the reinforcement plates 154 has been found to reduce failure and increase overall strength of the upper assembly. While in embodiments, the additional width added to the center board 118B may be negligible or may be the thickness of the plates 156 of the reinforcement of the plates 156 of the reinforcement plates 154, in embodiments, the connection blades 116 maybe spaced with additional width therebetween the combined center board 118B and reinforcement plates 154.

In exemplary embodiments, the reinforcement plate 154 may extend to position above the terminus of the connection blade 116. In one exemplary embodiment this may be three inches above the terminus of the connection blades while in another embodiment this may be twelve inches above the connection blade although it will be recognized that a wide variety of distances above the connection blade may be used for the terminus of the reinforcement plate 154.

Further as depicted in FIGS. 4A&B, the outer boards 118A are provided with starter holes 162 to facilitate the connection of the upper assembly to the lower assembly by a plurality of screws which extend through one or more of the boards 118 and one or more of the connection blades 116. FIGS. 5A and 5B depict an exemplary embodiment of a portion of the lower assembly includes the skeleton 108 and the connection bracket 110. As can be seen by reference to FIGS. 4A-5B, the starter holes 162 and similarly corresponding holes 164 located in an associated connection blade 116 are offset from the same holes on the other side of the assembly. For example when viewing the upper assembly from the face of either of the outside boards 118A, the starter holes 162 may exemplarily be shifted to the right relative to the starter holes 162 of the opposite outside board 118A. When viewing the connection blades 116 from the face of one of the connection blades, the holes 164 may exemplarily be shifted to the right relative to the holes 164 in the other connection blade 116. It will be recognized that this is merely an exemplary embodiment of this feature. The shifted holes 164 through the connection blades 116 can be seen in FIG. 5A. By offsetting the starter holes 162 of the outside boards 118A and holes 164 of the connection blades 116 relative to the opposing side of the composite assembly 102, screws can be used to extend through the exterior board 118A and the center board 118B as well as an associated connection blade 116 there between, and the associated reinforcement plate 154 from each of the sides of the composite assembly 102 without interference from the screws extending into the composite assembly from the other exterior board 118A.

FIG. 5A further depicts the end projections 134 of the skeleton 108 as shown in a more detailed view. In embodiments, the rebar of the support rods 112 may be bent to form the projections 134 with a rib of the rebar to the interior circumference and the exterior circumference of bend. Orientation of the rib of the rebar planar to the bent rebars in this manner may facilitate construction and strength of the skeleton 108. As further depicted in FIG. 5A, the end projections 134 are bent in a manner so as to maintain the end projections 134, and the entire support rod 112, within the columnar footprint as defined by the connection bracket 110 and which similarly corresponds to an outer perimeter of the body 106 as shown in FIG. 6 and the upper assembly 102 as shown in FIG. 1. This is exemplarily accomplished by bending the support rods 112 to form the projections 134 at differing angles. In FIG. 5A, support rods 112 secured to the same support plate may be oriented at differing angles from one another. In an example, one support rod 112 is rotated about the axis defined by the support rod 112 to an angle that is positive relative to the plane defined by the support plate 120. The other support rod secured to the support plate 120 is rotated about the axis defined by the support rod 112 to an angle negative to the plane defined by the support plate 120. In this manner the support rods 112 and the projections 134 are arranged to be within the columnar footprint which facilitates manufacturing processes for construction and removal of the lower assembly 104, while maintaining connection of the composite assembly 102 to the footing F.

As further shown in FIGS. 5A&B, rod connectors 166 extend between adjacent support rods 112 which are secured to different support plates 120 while the support plates 120 provide rigidity to the skeleton system 108, the provision of rod connecters 116 between the adjacent support rod 112 help to maintain the spatial relationship of the support rods 112 along the length of the skeleton 108, particularly by the portion of the skeleton interior to the body 108. While depicted as transverse rod connectors, it will be recognized that in other embodiments the rod connectors 116 may take other angles between support rods or may extend between support rods 112 which are connected to the same support plate 120.

FIG. 6 depicts an exemplary embodiment of a lower assembly 104. As described above, the lower assembly 104 includes a center hole 130. As represented in FIG. 6, the center hole 130 is tapered, or at least partially tapered at the lower end of the body 106. By way of example, the center hole 130 may be tapered from reference point A to reference point C. The center hole 130 may be the widest at the opening at reference point A. This may facilitate receiving an end of an adjustment leg with minimal engagement or interference from the material of the body 106. The center hole 130 may taper to reference point C and then maintain that diameter for the remainder of the center hole 130. In an exemplary embodiment, the center hole 130 has a diameter of 0.75 inches at reference point A and a diameter of 0.656 inches at reference point C. While this taper may be linear, in still other embodiments, the taper is bi- or multi-sloped. Reference point B may exemplarily have a diameter of 0.6875 in such an embodiment, the inward slope of the diameter is greater between reference points A and B, and shallower between reference points B and C.

In an embodiment, the body 106 further includes a grade indicia 168 which may exemplarily be molded or machined into the body 106. The grade indicia 168 may exemplarily be a hole that is configured to receive a nail within the hole to mark the grade relative to the composite assembly. In an exemplary embodiment, the grade indicia 168 is located at position twelve inches below the bottom plate 114 of the connection bracket 110. In use, the installation personnel may secure a nail within the grade indicia 168 and the sill plate (not depicted) may be supported by the nails placed in the created indicia across a plurality of composite assemblies to hold it in position prior to being secured to each of the composite assemblies.

Additionally, in FIG. 6 the foot 128 secured to the adjustment leg 126 is exemplarily shown in a circular form with a convex curve towards the outside. In an exemplary embodiment, this foot design facilitates positioning of the composite assembly within a hole in the ground whereas it has been found that the convex shape facilitates accurate positioning of the composite assembly within the hole and helps to maintain that positioning on the loose ground at the bottom of the hole. This loose ground material may be dirt, mud, gravel, or other ground material and reliable placement thereon can facilitate accurate positioning of the composite assembly and maintenance of that position while the footing is pouring and cured about the lower portion of the lower assembly.

Figure 8:
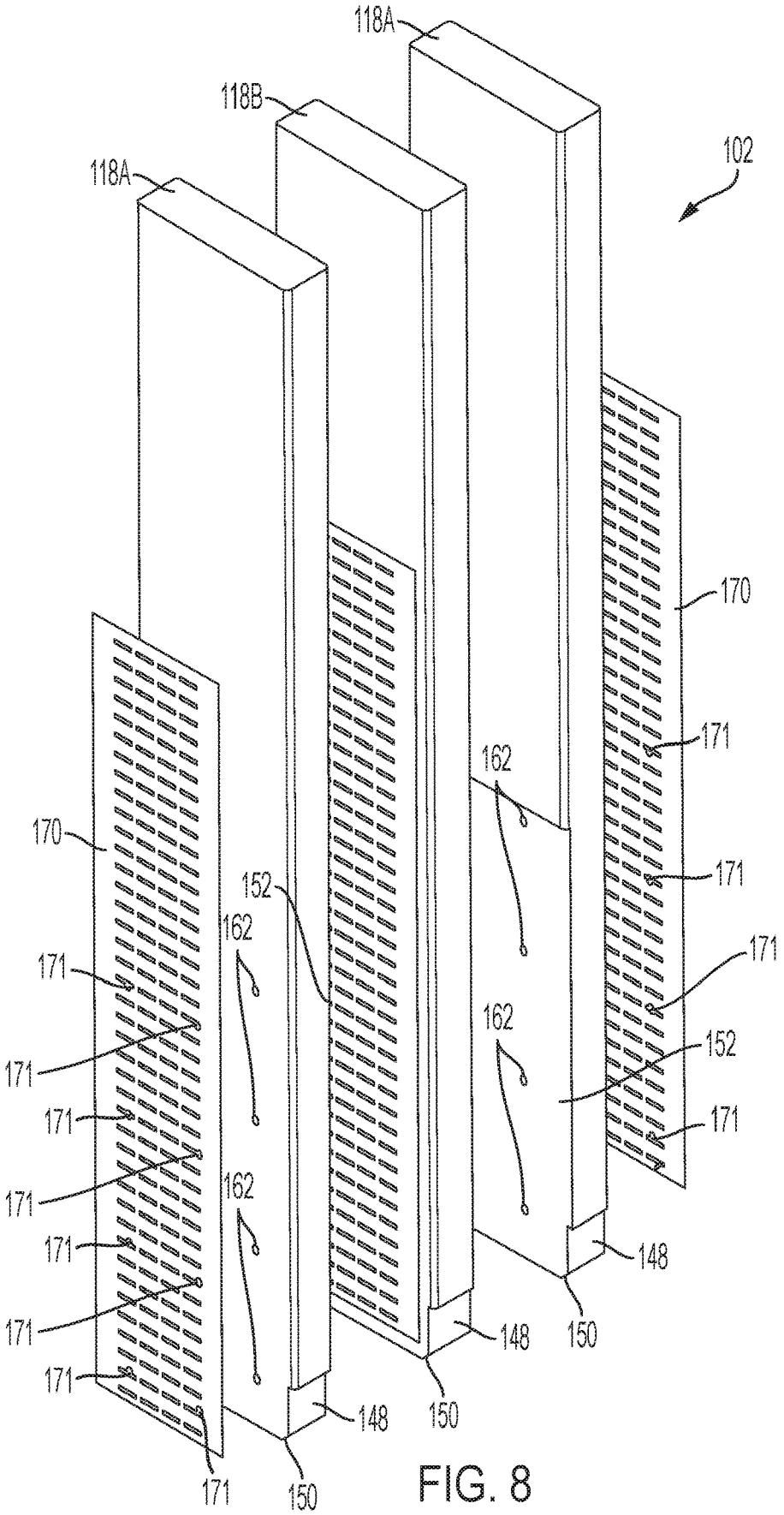
FIG. 8 is a partial exploded perspective view of an exemplary embodiment of an upper assembly.

FIG. 8 is a partial exploded perspective view of another exemplary embodiment of an upper assembly 102. The upper assembly 102 differs from that as depicted in FIGS. 4A&B as the upper assembly 102 in FIG. 8 includes exterior plates 170 secured to the outer faces of the outer boards 118A. Similar to the reinforcement plates 154 secured to the faces of the inner board 118B, the exterior plates 170 are one-way plates for example as shown in FIG. 7 and as described above. The exterior plates 170 are secured to the outer boards 118A exemplarily from a point interior of the lower end of the outer board 118A, for example ½ inch from the lower end of the outer board 118A, to a position beyond the terminus of the connection blade 116. The exterior plates 170 are similar in their use to the reinforcement plates 154, in that while such one-way connection plates are typically used to connect between adjacent boards, the exterior plates 170, as with the reinforcement plates 154, are each secured to a single board.

In an exemplary embodiment, the outer boards 118A are provided with pilot holes 162 which are in alignment with respective holes 164 in the connection blades 116 (see FIGS. 5A&B). In an embodiment with the exterior plates 170, the exterior plates 170 further include pilot holes 171. In an embodiment, the exterior plates 170 are secured to the outer boards 118A first so that the pilot holes 171 and 162 can be formed through the exterior plates 170 and the outer boards 118A in one drilling process. The pilot holes 171 and 162 facilitate proper placement of attachment screws (not depicted) to be in alignment to be received within respective holes 164, and also to facilitate driving the attachment screws into position and limit cracking or splitting of the outer boards 118A.

Figure 9A:
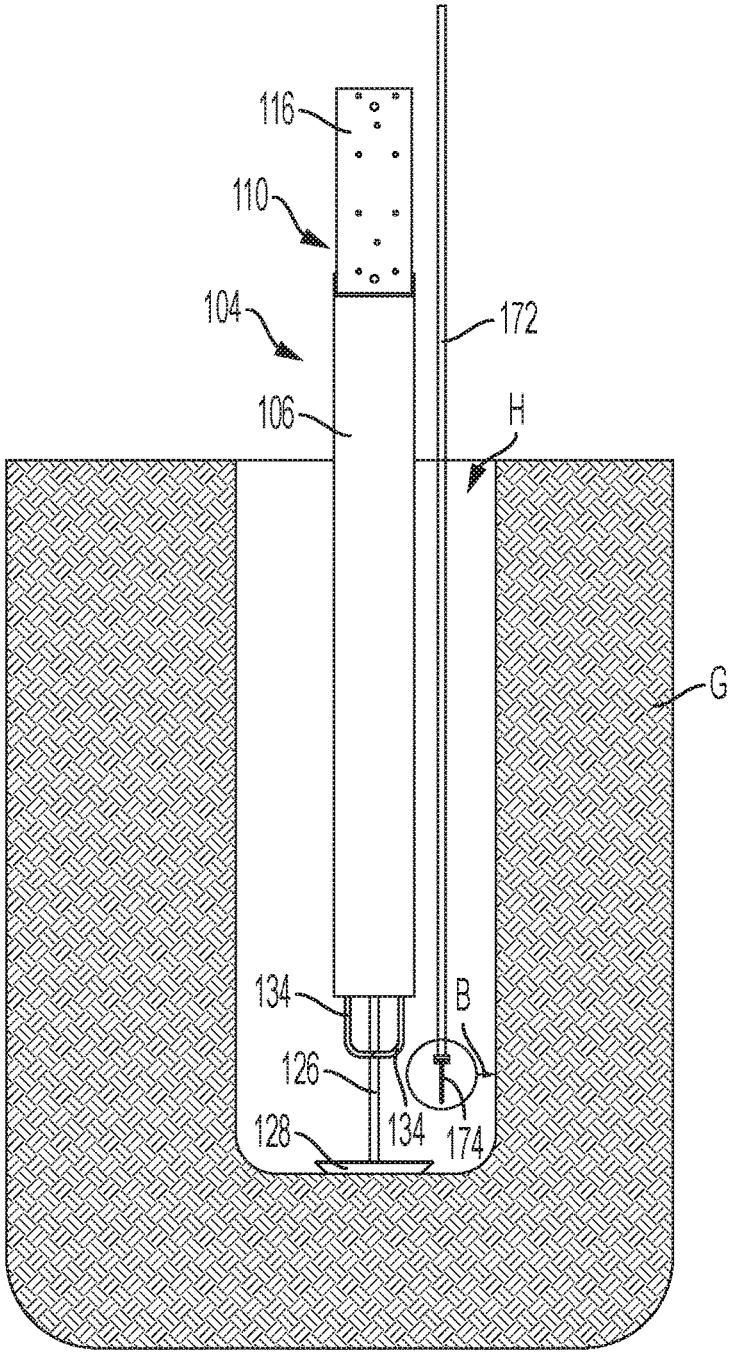
FIG. 9A depicts a further exemplary embodiment of a lower assembly in a hole.

FIG. 9A depicts an exemplary embodiment of a lower assembly 104, in a figure similar to that of FIG. 1. It will be recognized that similar features as described above with respect to FIG. 1 and denoted with similar reference numerals are also presented in FIG. 9A. The lower assembly 104 exemplarily includes an adjustment leg 126 that terminates in a convex shaped foot 128, as is shown and described above with respect to FIG. 6. While the convex shaped foot 128 facilitates positioning of the lower assembly 104 within the hole H, in embodiments, it is further desirable for the foot 128 to resist movement within the hole H, while the concrete or other footing material is poured and/or sets up about the foot 128 and at least a portion of the lower assembly 104.

Figure 9B:
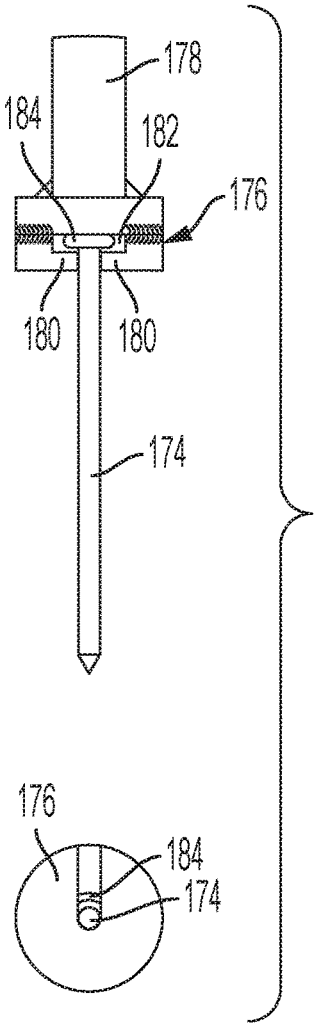
FIG. 9B depicts a partial close up view and a bottom view of a tacking rod.

FIG. 9B depicts a tacking rod 172 in partial close up and in an end view. The tacking rod 172 can carry and place a fastener 174, for example, a tack, a pin, or a staple between the foot 128 and the ground. The tacking rod 172 further includes a holder 176 at one end of a rod 178. The holder 176 is configured to releasably secure to the fastener 174 in a manner such that the fastener 174 can be directed into position by the tacking rod 172. Lips 180 depend from the rod 178 to form a cavity 182. The lips 180 engage a head 184 of the fastener 174 to retain the head 184 within the cavity 182.

The foot 128 may exemplarily include apertures (not depicted) that are configured to receive the fastener(s) therethrough. In an example, the apertures may be holes, slots, or cut outs extending into the foot 128 from an edge thereof. These apertures provide a manner by which the fasteners 174 can be inserted through the foot 128 into the ground, to retain the foot 128 in position while a footing is established around the foot 128. In an embodiment, a fastener 174 with a head 184 may engage the foot 128 with the head 184 to retain an engagement between the foot 128 and the fastener 174. In a further embodiment, the fastener 174, when positioned relative to the foot 128, extends beyond the plate of the foot 128 in both directions, both into the ground, but also above the foot 128. In an embodiment, the footing is formed about the foot 128, the adjustment rod 126 and one or more of the fasteners 174.

Figure 10:
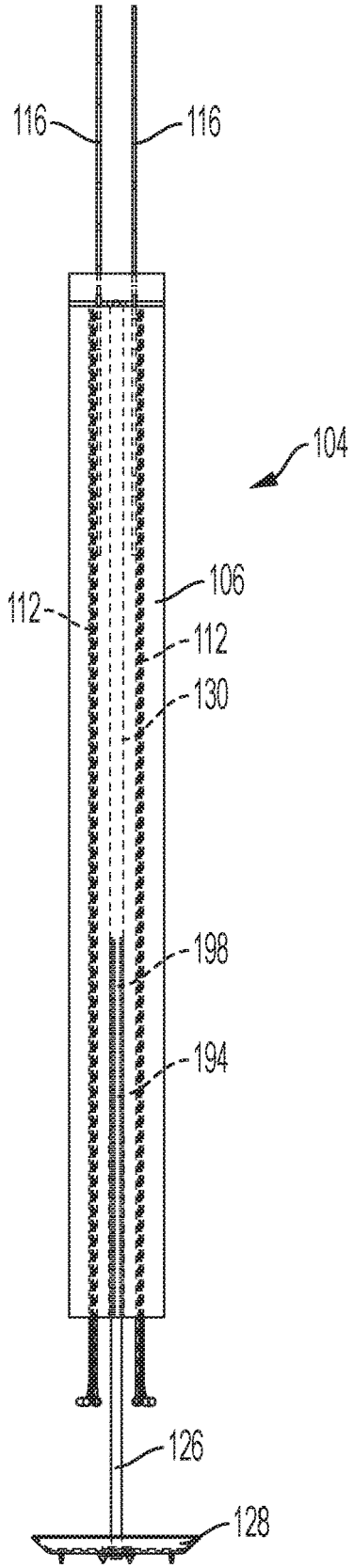
FIG. 10 depicts a further exemplary embodiment of a lower assembly.
Figure 11B:
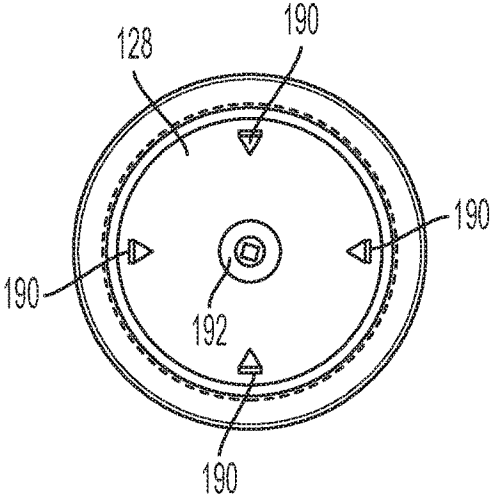
FIG. 11B is a bottom view of an exemplary embodiment of the adjustment leg.
Figure 11A:
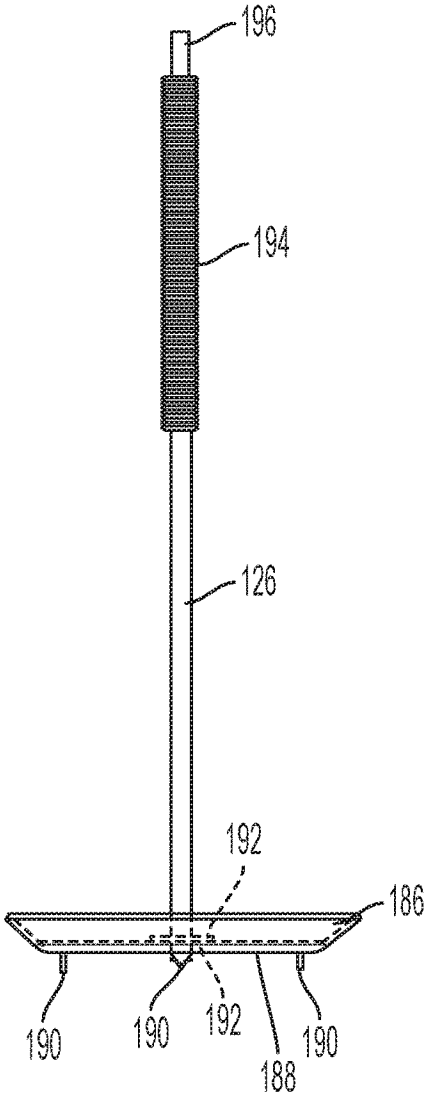
FIG. 11A is a side view of a exemplary embodiment of an adjustment leg.

FIG. 10 depicts a further exemplarily embodiment of a lower assembly 104. It will be recognized that features of the lower assembly depicted and described herein with respect to FIG. 10 may be used or combined with other various features in embodiments as earlier described while remaining within the scope of the present disclosure. The lower assembly 104 depicted in FIG. 10 includes an adjustment leg 126 and a foot 128. The adjustment leg 126 and foot 128 are depicted in larger detail in FIG. 11A. FIG. 11B is a bottom view of the foot 128.

The foot 128 is exemplarily curved as previously described, although as depicted in FIGS. 10 and 11, may include curved sides 186 and a flat bottom 188. Additionally, tabs 190 may extend from the flat bottom 188. The tabs 190 may exemplarily be punched from the material of the foot 128 and extend downwards therefrom. While in the embodiment depicted, four tabs are shown at orthogonal orientations to one another, it will be recognized that in another embodiment a series of parallely orientated tabs may be used and such embodiments may use more or fewer than four tabs, including, but limited to two tabs or six tabs. The voids provided from punching the tabs 190 out of the foot 128 may provide the aforementioned apertures for the fasteners 174. The tabs 190 may help to secure the foot 128 to the ground during adjustment of the position of the adjustment leg 126 and the body 106. The foot 128 further includes washers 192 which permit the foot 128 and the adjustment leg 126 to rotate relative to each other, for example when adjusting the height of the lower assembly 104 as described herein.

As previously described, the adjustment leg 126 may include ribs, ridges, scoring, or other texture to facilitate a friction fit between the adjustment leg 126 and the material of the body 106. In a further embodiment, the adjustment leg 126 includes a threaded portion 194. In one embodiment, the threaded portion 194 provides the engagement features of the adjustment leg 126 which increase friction between the adjustment leg and the material of the body 106 as the adjustment leg 126 is moved within the center hole 130. This may occur in the same manner as previously described by increasing an interference fit between the adjustment leg 126 and the material of the body 106 within which the center hole 130 is defined.

In another embodiment, the adjustment leg 126 is provided with a connection feature 196. The connection feature 196 may either be a male or female end of a socket connection and may be any of a variety of known cross sectional shapes, including, but not limited to, square, hexagon, or star shapes. In such an exemplary embodiment, the adjustment rod (not depicted) inserted through the hole 132 in the connection bracket 110 and into the center hole 130 of the body 106 is fitted with the mating portion of the connection feature 196 and maybe rotated either manually or with a tool for example a drill or air compression tool to threadingly extend or retract the adjustment leg 126 within the center hole 130. Due to the resilient nature of the material of the body 106, the threaded portion 194 of the adjustment leg 126 may embed into the material of the body 126 due to the interference fit and dimensioning of the center hole.

In a further embodiment, the center hole 130 may be molded with receiving threads 198, at least along a portion of the center hole 130 that is likely or potentially to engage with the adjustment rod 126. The receiving threads 198 may be molded into the body 106 during the construction of the body 106 or may be drilled into the body 106 in a separate manufacturing process. In an embodiment, preproviding the receiving threads 198 into the center hole 130 can help to facilitate the extension and retraction of the adjustment leg 126 into and out of the center hole 130 of the body 106. In an exemplary embodiment, the interference between the center hole 130 and the adjustment leg 126 may be increased with the provision of the receiving threads 198 to provide an increased interference while the receiving threads 198 ease the extension and retraction of the adjustment leg 126 with the center hole 130.

In a still further exemplary embodiment, the receiving threads 198 may be provided in the center hole 130 while the adjustment leg 126 is provided with a smooth surface or a surface with an engagement feature other than the threaded portion 194 as described above. In such an embodiment, the interference fit between the adjustment leg 126 and the center hole 130 can be provided with a greater interface by reducing the diameter of the center hole 130 while the movement of the adjustment leg 126 within the center hole is facilitated by the reduced material in the interference between the adjustment leg 126 and the center hole due to the threads. The size and depth of the threads may further be adjusted or selected relative to the dimensions and or engagement features of the adjustment leg 126 to provide a desired tightness of the interference fit.

Figure 12:
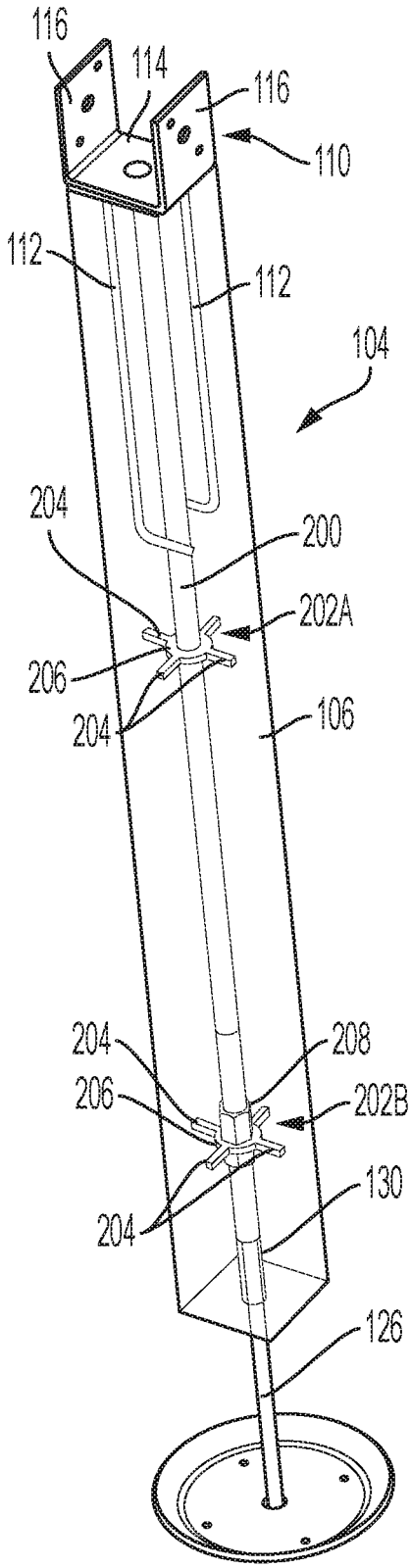
FIG. 12 depicts a further exemplary embodiment of a lower assembly.

FIG. 12 depicts a further exemplary embodiment of a lower assembly as disclosed herein. As with other embodiments disclosed, it will be recognized that aspects of this embodiment may be combined with aspects of other embodiments disclosed herein to arrive at still further embodiments that are within the scope of the present disclosure. The lower assembly 104 includes a connection bracket 110 and a plastic or other non-wood body 106.

The connection bracket 110 includes a bottom plate 114. Two connection blades 116 extend upwards from the peripheral edges of the bottom plate 114. The connection blades 116 are configured to be secured against exterior faces of an upper assembly (not depicted). Support rods 112 are secured, for example by welding, to the bottom of the bottom plate 114. A center tube 200 extends from the bottom of the bottom plate 114, between the support rods 112. The center tube 200 is exemplarily constructed of metal and defines an axial hole down the middle of the tube 200. The tube 200 is in alignment with a hole (not depicted) in the center of the bottom plate 114. In exemplary embodiments, the center tube 200 extends along the center hole 130. The body 106 surrounds the center tube 200 and the support rods 112.

The lower assembly 104 includes two embodiments of support extensions 202A and 202B. The support extensions 202A and 202B radially extend away from the center tube 200 in the direction of the outer faces of the body 106 of the lower assembly 104. Each support extension 202A and 202B exemplarily includes four arms 204, one extending in a direction orthogonal to each of the faces of the body 106. Support extension 202A includes a support ring 206, which is exemplarily in the shape of a circle and secured around the center tube 200. The arms 204 extend from the support ring 206. Support extension 202B further includes a mounting nut 208. The support ring 206 is exemplarily in the shape of a hexagon or other matching shape to the exterior of the mounting nut 208. The mounting nut 208 is secured to the center tube 200, and the support extension 202A or 202B is secured to the mounting nut 208.

The lower assembly 104 further includes an adjustment leg 126. The adjustment leg 126 is exemplarily the same as described above with respect to FIGS. 11A and B. However, the center tube 200 may include a threaded interior at a lower end thereof. The threads of the center tube 200 may be configured to receive and engage the threaded portion 194 of the adjustment leg 126. In this example, the center hole 130 may have the same or similar interior diameter as an exterior diameter of the center tube 200. The body 106 and the center hole 130 may extend beyond the center tube 200 and the upper end of the adjustment leg 126 received within the center hole 130 before threadingly engaging the center tube 200. In a further embodiment, a nut or other threaded restriction may be positioned within the end of the center tube and therefore provide a portion with threaded engagement, while the rest of the interior diameter of the center tube 200 exceeds that of the adjustment leg 126.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A building support column comprising:

a lower assembly comprising:

a connection bracket comprising a bottom plate, first and second connection blades extending away from the bottom plate in a first direction, and a hole through the bottom plate in a position between the first and second connection blades;

a plurality of support rods secured to the connection bracket and extending away from the bottom plate in a direction opposite the connection blades;

a body comprising plastic defining an exterior perimeter about the plurality of support rods, a center hole oriented along a central axis of the body and aligned with the hole of the bottom plate; and an adjustment leg comprising a threaded portion along the adjustment leg with a foot secured to an exterior end of the adjustment leg, the adjustment leg movable within the center hole at a position separated from the bottom plate to define a distance between the foot and the bottom plate and the threaded portion providing engagement between the adjustment leg and the body.

2. The building support column of claim 1, wherein the threaded portion is located along an interior end of the adjustment leg, the interior end of the adjustment leg being an end of the adjustment leg opposite the foot.

3. The building support column of claim 2, wherein the interior end of the adjustment leg is configured to be received within the center hole of the body.

4. The building support column of claim 3, wherein the engagement between the adjustment leg and the body is an interference or friction fit between the threaded portion and the body.

5. The building support column of claim 3, wherein the center hole comprises receiving threads along the center hole.

6. The building support column of claim 5, wherein the receiving threads are located at an end of the center hole of the body opposite from the connection bracket.

7. The building support column of claim 5, wherein the receiving threads are molded into the plastic of the body along the center hole.

8. The building support column of claim 5, wherein the receiving threads are machined into the plastic of the body along the center hole.

9. The building support column of claim 5, wherein threads of the threaded portion embed into the body along the center hole.

10. The building support column of claim 3, further comprising a center tube that is within the body along the center hole of the body and wherein the interior end of the adjustment leg is received within the center tube.

11. The building support column of claim 10, wherein the center tube is secured to the bottom plate and aligned with the hole of the bottom plate and extends within the body along the center hole of the body.

12. The building support column of claim 11, wherein the center tube comprises receiving threads, the receiving threads of the center tube engaging the threaded portion of the adjustment leg to provide a movable connection between the adjustment leg and the center tube.

13. The building support column of claim 12, further comprising a support extension secured to the center tube with a plurality of arms that each extend radially away from the center tube in directions orthogonal to each center tube orthogonal to faces of the body forming the perimeter of body.

14. The building support column of claim 1, wherein the adjustment leg further comprises a connection feature at the interior end of the adjustment leg.

15. The building support column of claim 14, wherein the connection feature comprises an end of a socket connection.

16. The building support column of claim 1, wherein the body further comprises wood.

17. The building support column of claim 1, further comprising an upper assembly comprising a plurality of elongated layers of wood, the plurality of elongated layers of wood secured to each other along elongated faces of the layers of wood, wherein the connection bracket secures the upper assembly to the lower assembly with the connection blade extending between the elongated faces of adjacent elongated layers of the upper assembly.

18. A building support column comprising:

a lower assembly comprising:

a connection bracket comprising a bottom plate, first and second connection blades extending away from the bottom plate in a first direction, and a hole through the bottom plate in a position between the first and second connection blades;

a plurality of support rods secured to the connection bracket and extending away from the bottom plate in a direction opposite the connection blades;

a body comprising plastic defining an exterior perimeter about the plurality of support rods, a center hole oriented along a central axis of the body and aligned with the hole of the bottom plate; and an adjustment leg comprising a threaded portion along the adjustment leg with a foot secured to an exterior end of the adjustment leg, the adjustment leg movable within the center hole at a position separated from the bottom plate to define a distance between the foot and the bottom plate and the threaded portion providing engagement between the adjustment leg and the body; and an upper assembly comprising:

a plurality of elongated layers of wood, the plurality of elongated layers of wood secured to each other along elongated faces of the layers of wood, wherein the connection bracket secures the upper assembly to the lower assembly with the connection blade extending between the elongated faces of adjacent elongated layers of the upper assembly; and a reinforcement plate comprising a plate and a plurality of teeth extending away from a first side of the plate, wherein the teeth of the reinforcement plate engage into a single elongated layer of the plurality of elongated layers.

19. The building support column of claim 1, wherein the support rods extend out of the body at an end opposite the connection bracket and each support rod includes an end projection that is oriented non-axial to a portion of the support rod, and the end projections are within the exterior perimeter of the body.

20. The building support column of claim 1, wherein the foot comprises a plurality of tabs extending from the foot in a direction opposite the adjustment leg, the plurality of tabs located interior of an upturned outer edge that defines a void centered about the central axis and facing the adjustment leg.

* * * * *